United States Patent [19]

White

[11] 4,364,670

[45] Dec. 21, 1982

[54] ELECTROPHORETIC ELAPSED TIME INDICATOR

[75] Inventor: Roger P. White, Yonkers, N.Y.

[73] Assignee: North American Philips Corporation, New York, N.Y.

[21] Appl. No.: 97,997

[22] Filed: Nov. 28, 1979

[51] Int. Cl.[3] ..... G04C 17/60

[52] U.S. Cl. ..... 368/114; 368/239; 204/299 R

[58] Field of Search ..... 204/180, 299; 368/89, 368/114; 340/700, 787

[56] References Cited

U.S. PATENT DOCUMENTS

| | | | |
|---|---|---|---|
| 3,607,256 | 7/1968 | Silverberg | 204/299 |
| 3,839,857 | 10/1974 | Berets et al. | 340/785 |
| 4,062,009 | 12/1977 | Raverdy et al. | 204/299 |

FOREIGN PATENT DOCUMENTS

| | | | |
|---|---|---|---|
| 27461 | 9/1955 | Fed. Rep. of Germany | 368/114 |

OTHER PUBLICATIONS

Curtis Instrument Inc. Brochure, "Curtis Elapsed Time Indicator", 9/71.

*Primary Examiner*—Bernard Roskoski
*Attorney, Agent, or Firm*—Paul R. Miller

[57] ABSTRACT

An elapsed time indicator is constructed to operate by electrophoresis wherein light colored particles suspended in an organic liquid are caused to move in a tube device by applied electric fields. The movement of the colored particles results in a visible color bar being indicative of the transit time of the particle, and providing an indication of elapsed time. Reversal of the polarity on the device results in its reuse.

6 Claims, 2 Drawing Figures

ELECTROPHORETIC ELAPSED TIME INDICATOR

BACKGROUND OF THE INVENTION

Figure 1:
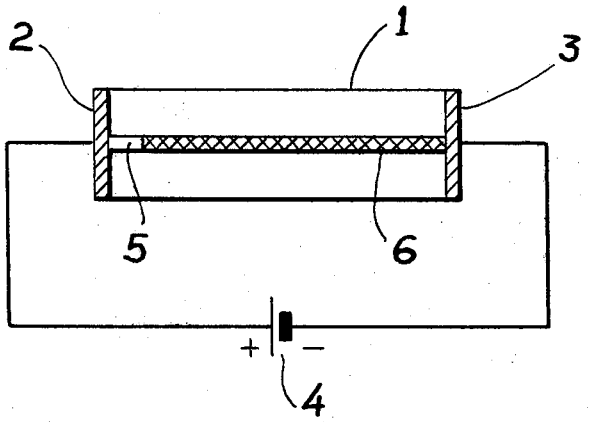

The present invention is directed to an elapsed time indicator, and more particularly, an elapsed time indicator utilizing electrophoretic effects to move suspended pigment particles in an electric field in times certain.

Elaspsed time indicators have been contemplated using electroplating effects. Such devices have been utilized in vidicon tubes, recording heads and klystrons to indicate elapsed time of operation for this equipment. Such prior devices are current dependent, and must utilize rated resistors to obtain the proper current for the desired time interval from a specified DC voltage.

Moreover, prior elapsed time indicators operate on an irreversible electrolytic deposition techniques, such as those described in U.S. Pat. No. 2,970,264. As such, irreversible type elapsed time indicators are costly inasmuch as they are not reusable, and require extensive circuitry for current control.

The present invention seeks to avoid these difficulties in the prior art by providing an elapsed time indicator operating under principles of electrophoresis. Principally, such electrophoretic elapsed time indicators are voltage dependent, requiring only simple voltage regulators for proper operation, are reversible, and can be utilized for any desired elapsed time by simply providing the proper applied voltage.

These effects may be accomplished according to the present invention by suspending very fine pigment particles in an organic liquid between two electrodes. Electrophoresis is an electrokinetic effect wherein solid particles move in a liquid upon the application of a potential gradient across the liquid. In accordance with the elapsed time indicator of the present invention, the pigment particles may be of a given color, while the liquid suspension may be dyed of an opposite color. For example, the pigment particles may be light in color while a dark color dye may be added to the liquid suspension.

Accordingly, upon the application of a voltage across the electrophoretic suspension, the light color pigment particles will be attracted to an electrode of opposite polarity. When the polarity on the electrodes is reversed, the light colored pigments will be caused to move in the liquid to the opposite electrode, thereby resulting in a change of color as the light colored pigments move toward the opposite electrode.

If the electrophoretic suspension is within a small diameter tube having electrodes at each end, then the movement of the light colored pigment particles from one end of the tube to the opposite end will result in a light colored bar being transmitted the length of the tubing. Since the movement of the pigment particles occurs in a transist time dependant upon the applied voltage, the distance between the electrodes, and the electrophoretic mobility, then the position of the light bar in the tube provides an indication of elapsed time.

Thus, it can be shown that the electrophoretic transit time t may be given by the relationship $$t=d/v \tag{1}$$

where d is the distance and v is the velocity

The particle velocity is the product of the electrophoretic mobility u and the electric field V/d where V is the applied voltage. Accordingly, the article velocity becomes $$v=u(V/d) \tag{2}$$

The electrophoretic mobility of spherical particles is given by the following relationship $$u\text{-}\epsilon\zeta/6\pi\eta \tag{3}$$

Where $\epsilon$ and $\eta$ are the dielectric constant and viscosity, respectively, of the suspending medium, and $\zeta$ is the zeta potential. Combining equations (2) and (3) into equation (1), it is apparent that the transit time is proportional to the viscosity and to the square of the distance between the electrodes, and inversely proportional to the applied voltage, the dielectric constant, and the zeta potential.

$$t=6\pi d^2\eta/V\epsilon\zeta \tag{4}$$

Accordingly, the distance between the electrodes and the applied voltage are two parameters for controlling the transit time, which can be easily controlled. Of the two, the distance between the electrodes provides the most dramatic change.

BRIEF DESCRIPTION OF THE DRAWING FIGURE

Figure 2:
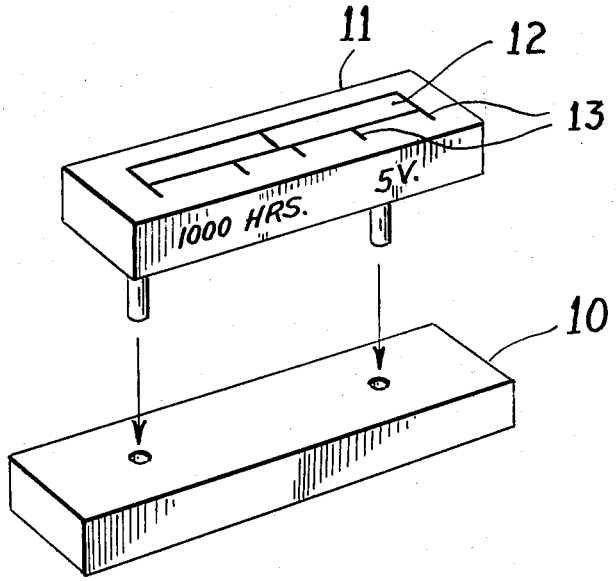

A better understanding of the present invention may be obtained by reference to the attached drawing figures, which provide in non-limiting example embodiments of the present invention, wherein FIG. 1 illustrates a cross-sectional view of an electrophoretic elapsed time indicator in accordance with the present invention, and FIG. 2 shows another example of the electrophoretic elapsed time indicator according to the present invention.

DETAILED DESCRIPTIONS OF AN EMBODIMENT

Referring to FIG. 1, an electrophoretic elapsed time indicator in accordance with the present invention is illustrated in the form of a capillary glass tubing 1 having each end sealed with a conductive epoxy providing respective electrodes 2 and 3. Light colored pigment particles having a very fine diameter (of the order of 0.5 microns) are suspended in an organic liquid 6 to which a dark colored dye has been added.

Upon the application of a DC voltage from a source 4, then the pigment particles may be attracted to one or the other of the electrodes 2 or 3. Assuming the pigment particles to have a negative charge, then the particles will be attracted to the positive electrode 2, and a very small light bar 5 will be visible through the wall of the glass tube. Reversing the polarity of the DC voltage, will cause the pigment particles 5 to be transmitted toward the opposite electrode 3 along the length of the tube 1. The movement of the light colored pigment particles through the liquid suspension having the dark dye will result in the movement of the light colored bar down the length of the glass tubing to arrive in time at the opposite electrode 3. Since the transit time of the electrophoretic suspension can be calculated in a time certain, primarily dependent upon the distance between the electrodes and inversely to the voltage applied to the electrodes, then the movement of the light colored particles provides an elapsed time indication.

In an example of operation of an embodiment of the present invention, the length d of the glass tubing may be 3 centimeters, the viscosity $\eta$ of the suspending medium may be $10^{-2}$ poise, the voltage applied to the electrodes 2 and 3 may be 5 volts, the zeta potential may be $46.3\times10^{-3}$ volts, and the dielectric constant $\epsilon$ is 2.3. In an elapsed time indicator according to the present invention having these parameters, and having a suspension of a Dairylide Y yellow pigment, then the elapsed time indicator would have a range of t=1000 hours.

A typical electrophoretic suspension may consist of 15 cc of a 7:3 mixture of perchlorethylen: xylene (specific gravity adjusted to 1.41), 420 mgs of diarylide yellow pigment, 40 mgs of Sudan Red-4BA dye, and 210 mgs of FC-170-fluorinated alkyl polyoxyethene ethanol (1%) or FC-430-fluorinated alky esters (1% by st.).

In use, the elapsed time indicator of the present invention would be supplied with the pigment particles already attracted to one of the electrodes 2, 3. For use in AC circuits, a rectifying diode would be placed in series with the device to provide the DC voltage necessary for operation of the device. A Zener diode may be incorporated to provide a predetermined and constant applied voltage. Reversal of the polarity on the device would permit its reuse.

FIG. 2 illustrates an indicator according to the present invention which is partially broken-away for illustrative purposes. This indicator comprises a socket 10 and molded housing 11 containing the indicator 12. The indicator may be of the same type previously discussed with respect to FIG. 1. The molded housing 11 is designed to plug into the socket 10, as shown, so that when the indicating bar reaches the end of the tube, then the unit may be simply unplugged and reversed. The socket 10 may include the necessary diode structures for operation. Guarantee type devices may be used with guarantees to operate, for example, for 1000 hours. For guarantee operations, however, it may not be desirable to unplug and reverse the unit.

While I have described in non-limiting example embodiments of the present invention, various changes, modifications and other embodiments may be apparent to those of ordinary skill in the art, and included within the scope of the following claims.

I claim:

1. An electrophoretic elapsed time indicator comprising an electrophoretic suspension including colloidal particles suspended in a liquid, said particles providing a contrasting color to said liquid, means including a small inside diameter transparent tube for containing said electrophoretic suspension, and means including respective electrodes at each end of said tube for applying a DC voltage across said containing means and moving said particles from one end of said tube to the other end of said tube under said DC voltage in a predetermined time period for indicating said time period.

2. An electrophoretic elapsed time indicator according to claim 1, wherein said particles are of a light colored pigment, and a dark colored dye is contained in said liquid.

3. An electrophoretic elapsed time indicator according to claim 2, wherein means are provided for regulting said DC voltage.

4. An electrophoretic elapsed time indicator according to claim 3, wherein said DC voltage applied to said containing means is reversed in polarity.

5. An electrophoretic elapsed time indicator according to claim 1, wherein said small inside diameter tube has a diameter of the order of 0.5 microns.

6. An electrophoretic elapsed time indicator according to claim 1, wherein said means for containing said electrophoretic suspension includes a molded housing plugged into an elongated socket.

* * * * *

UNITED STATES PATENT AND TRADEMARK OFFICE

CERTIFICATE OF CORRECTION

PATENT NO. : 4,364,670

DATED : December 21, 1982

INVENTOR(S) : ROGER P. WHITE

It is certified that error appears in the above—identified patent and that said Letters Patent is hereby corrected as shown below:

Column 2, Line 1, change "article" to --particle--.

Column 3, Line 19, change "st." to --wt.--.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*